US007819177B2

(12) United States Patent
Beamer et al.

(10) Patent No.: US 7,819,177 B2
(45) Date of Patent: Oct. 26, 2010

(54) HEAT EXCHANGER ASSEMBLY

(75) Inventors: Henry Earl Beamer, Middleport, NY (US); Robert Michael Runk, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 106 days.

(21) Appl. No.: 12/354,957

(22) Filed: Jan. 16, 2009

(65) Prior Publication Data

US 2009/0120627 A1 May 14, 2009

Related U.S. Application Data

(63) Continuation of application No. 11/492,477, filed on Jul. 25, 2006, now abandoned.

(51) Int. Cl.
*F28F 9/02* (2006.01)

(52) U.S. Cl. ..... 165/174; 165/153; 165/175

(58) Field of Classification Search ..... 165/152, 165/153, 173, 174, 175, DIG. 481, DIG. 482, 165/DIG. 483
See application file for complete search history.

(56) References Cited

U.S. PATENT DOCUMENTS

| | | | |
|---|---|---|---|
| 1,684,083 | A | 6/1927 | Bloom |
| 1,701,617 | A | 2/1929 | Hyde |
| 2,419,575 | A | 4/1947 | Leonard |
| 3,976,128 | A | 8/1976 | Patel et al. |
| 5,067,561 | A | 11/1991 | Joshi et al. |
| 5,168,925 | A | 12/1992 | Suzumura et al. |
| 5,203,407 | A | 4/1993 | Nagasaka |
| 5,415,223 | A | 5/1995 | Reavis et al. |
| 5,503,223 | A | 4/1996 | Choi et al. |
| 5,586,600 | A | 12/1996 | Cribari |
| 5,622,219 | A | 4/1997 | Voss et al. |
| 5,638,900 | A | 6/1997 | Lowenstein et al. |
| 5,651,268 | A | 7/1997 | Aikawa et al. |
| 5,685,366 | A | 11/1997 | Voss et al. |

(Continued)

FOREIGN PATENT DOCUMENTS

| | | |
|---|---|---|
| DE | 10 57 148 | 5/1959 |

(Continued)

OTHER PUBLICATIONS

European Search Report dated Feb. 13, 2008.

(Continued)

*Primary Examiner*—Teresa J Walberg
(74) *Attorney, Agent, or Firm*—Patrick M. Griffin

(57) ABSTRACT

A heat exchanger assembly includes a first single-piece manifold and a second single-piece manifold spaced from and parallel to the first single-piece manifold. Each of the first and second single-piece manifolds has a tubular wall defining a flow path. A plurality of flow tubes extend in parallel between the first and second single-piece manifolds and are in fluid communication with the flow paths. An insert having a distribution surface is slidably disposed in the flow path of the first single-piece manifold to establish a distribution chamber within the first single-piece manifold. A series of orifices defined in the distribution surface of the insert are in fluid communication with the flow path and the distribution chamber for uniformly distributing a heat exchange fluid between the flow path and the flow tubes.

16 Claims, 8 Drawing Sheets

U.S. PATENT DOCUMENTS

| | | | | |
|---|---|---|---|---|
| 5,752,566 | A | 5/1998 | Liu et al. | |
| 5,765,633 | A | 6/1998 | Hu | |
| 5,806,586 | A | 9/1998 | Osthues et al. | |
| 5,836,382 | A | 11/1998 | Dingle et al. | |
| 5,894,886 | A * | 4/1999 | Chiba et al. | 165/174 |
| 5,896,754 | A | 4/1999 | Balthazard et al. | |
| 5,941,303 | A | 8/1999 | Gowan et al. | |
| 5,971,065 | A | 10/1999 | Bertilson et al. | |
| 5,988,267 | A | 11/1999 | Park et al. | |
| 6,082,448 | A | 7/2000 | Haussmann | |
| 6,125,927 | A | 10/2000 | Hubert | |
| 6,161,616 | A | 12/2000 | Haussmann | |
| 6,220,342 | B1 | 4/2001 | Nishishita et al. | |
| 6,267,173 | B1 | 7/2001 | Hu et al. | |
| 6,276,447 | B1 | 8/2001 | Iguchi et al. | |
| 6,341,648 | B1 | 1/2002 | Fukuoka et al. | |
| 6,769,269 | B2 | 8/2004 | Oh et al. | |
| 6,892,805 | B1 | 5/2005 | Valensa | |
| 2003/0116310 | A1 | 6/2003 | Wittmann et al. | |
| 2004/0026072 | A1 | 2/2004 | Yi et al. | |
| 2004/0159121 | A1 | 8/2004 | Horiuchi et al. | |
| 2005/0006081 | A1 * | 1/2005 | Kamiyama et al. | 165/174 |
| 2005/0247443 | A1 | 11/2005 | Kim | |

FOREIGN PATENT DOCUMENTS

| | | |
|---|---|---|
| DE | 198 43 031 | 4/1999 |
| EP | 0 798 519 | 10/1997 |
| EP | 1 365 200 | 11/2003 |
| FR | 2 735 851 | 12/1996 |
| GB | 2 366 363 | 3/2002 |
| JP | 1067592 | 3/1989 |
| WO | WO 94/14021 | 6/1994 |

OTHER PUBLICATIONS

Partial European Search Report dated Oct. 31, 2007.

* cited by examiner

HEAT EXCHANGER ASSEMBLY

This application is a continuation of U.S. patent application Ser. No. 11/492,477 filed Jul. 25, 2006. The disclosure of this earlier filed application is hereby incorporated by reference in its entirety.

FIELD OF THE INVENTION

The present invention generally relates to a heat exchanger assembly. More specifically, the present invention relates to a heat exchanger assembly including an insert for uniformly distributing and directing a heat exchange fluid within the heat exchanger assembly.

DESCRIPTION OF THE RELATED ART

Heat exchanger assemblies currently used in automobiles are being further developed and refined for use in commercial and residential heat pump systems due to their desirable high heat exchange performance. Typically, the heat exchanger assemblies used in automobiles include a pair of spaced and parallel manifolds with a series of parallel flow tubes extending therebetween. The flow tubes communicate a heat exchange fluid, i.e., a refrigerant, between the two manifolds. Air fins are disposed between the flow tubes to add surface area to the heat exchanger assembly for further aiding in heat transfer to or from ambient air passing over the flow tubes. The heat exchanger assemblies include an inlet and an outlet for transferring the refrigerant to and from the heat exchanger assembly in a continuous closed-loop system.

In downflow, crossflow, and one-pass heat exchanger assemblies, the inlet is disposed in one manifold, and the outlet is disposed in the other manifold. Typically, the inlet and the outlet are kitty-corner each other, attempting to fully utilize all of the flow tubes between the manifolds. However, due to poor internal distribution of the refrigerant, and temperature and pressure differences within the manifolds and the flow tubes, some of the flow tubes receive more or less of the refrigerant than the other flow tubes, causing an unequal heat transfer burden on each one of the flow tubes, which decreases heat exchange performance of the heat exchanger assembly.

Conversely, in a multi-pass heat exchanger assembly, both the inlet and the outlet may be spaced apart and disposed in the same manifold. Typically, the heat exchanger assemblies used in commercial or residential heat pump system are multi-pass. A plurality of separator plates, i.e., baffles, are disposed within each of the manifolds to form a plurality of passes with each of the passes including a group of flow tubes. In a typical heat exchange loop, the refrigerant enters through the inlet into one of the manifolds, flows through all of the passes between the manifolds, and then exits one of the manifolds through the outlet. The baffles and the passes alleviate some of the distribution problems of the refrigerant within the heat exchanger assembly. However, there is still uneven distribution of the refrigerant between each of the individual flow tubes within each of the passes.

Typically, the heat exchanger assemblies used in commercial or residential heat pump systems are two to three times larger than the heat exchanger assemblies used in automobiles. This increased size magnifies the aforementioned distribution problems of the refrigerant within the heat exchanger assembly, and further adds to manufacturing costs due to the increased difficulty of properly locating and fixing the baffles within each of the manifolds to form the passes.

Typically, the heat exchanger assemblies can function as a condenser in cooling mode or an evaporator in heating mode for respectively cooling or heating a commercial or residential building. Velocity and distribution of the refrigerant within the heat exchanger assembly varies between the cooling and heating modes and can further decrease heat exchange performance of the heat exchanger.

For example, in heating mode, a two-phase refrigerant comprising a liquid and gas phase enters the inlet of the heat exchanger assembly, i.e., the evaporator, and flows through the passes. While traveling through the passes, the two-phase refrigerant absorbs heat from the ambient air passing over the flow tubes and air fins, which causes the liquid phase to further evaporate and the gas phase to further expand. Momentum effects due to large mass differences between the liquid and gas phases causes separation of the two-phase refrigerant. Separation of the phases adds to the already present distribution problem within the passes, which further decreases overall heat exchange performance of the evaporator. Separation of the two-phase refrigerant can also cause localized icing or frosting of individual or groups of flow tubes within the evaporator, causing plugging of the flow tubes and yet further lowering the heat exchange performance of the evaporator.

To increase heat exchange performance, a distributor tube can be used to improve refrigerant distribution within the evaporator. U.S. Pat. No. 1,684,083 to Bloom (the '083 patent), discloses a distributor tube disposed within a manifold of a refrigerating coil. The distributor tube includes a series of orifices and is attached to an inlet for distributing a refrigerant from the inlet to a group of flow tubes attached to the manifold. The distributor tube essentially extends a length of the manifold and acts as an extension of the inlet, with each of the orifices communicating a portion of the refrigerant to each of the flow tubes. However, the distributor tube in the '083 patent is welded in place, and therefore is not movable or removable from the manifold. Due to the distributor tube requiring welding to remain in place within the manifold, manufacture of the refrigerating coil is difficult due to demands of properly locating and welding the distributor tube in place within the manifold. In addition, the distributor tube is limited to a one-pass configuration, due to the distributor tube extending the length of the manifold. U.S. Pat. No. 5,836,382 to Dingle et al., and WO 94/14021 to Conry, disclose similar distributor tubes for a shell and tube evaporator and a plate type heat exchanger, respectively. However, both the shell and tube evaporator and the plate type heat exchanger are limited to the same '083 patent one-pass configuration limitation.

U.S. Pat. No. 5,941,303 (the '303 patent) to Gowan et al., discloses an extruded manifold. The extruded manifold includes integral partitions for distributing a refrigerant to a plurality of multi-passage flow tubes. However, extruded manifolds are typically expensive when compared to typical welded manifolds. In addition, the integral partitions limit the extruded manifold to one flow configuration.

U.S. Pat. No. 5,203,407 (the '407 patent) to Nagasaka, discloses a multi-pass heat exchanger assembly including internal walls in a pair of manifolds for distributing a refrigerant to passes. The passes include groups of flow tubes within the heat exchanger assembly. However, as in the '083 patent and the '303 patent, the internal walls are fixed and integral in the manifolds, thereby limiting the heat exchanger to one flow configuration. In addition, the '407 patent suffers from distribution problems among each of the individual flow tubes within each of the passes.

Thus, there remains a need to develop a heat exchanger assembly having an insert that provides a cost effective, flexible, and efficient solution for uniformly distributing a heat exchange fluid to a plurality of flow tubes within the heat exchanger assembly.

SUMMARY OF THE INVENTION AND ADVANTAGES

The present invention is a heat exchanger assembly. The heat exchanger assembly includes a first single-piece manifold and a second single-piece manifold spaced from and parallel to the first single-piece manifold. Each of the first and second single-piece manifolds has a tubular wall defining a flow path. A plurality of flow tubes extend in parallel between the first and second single-piece manifolds and are in fluid communication with the flow paths. An insert having a distribution surface is slidably disposed in the flow path of the first single-piece manifold to establish a distribution chamber within the first single-piece manifold. A series of orifices defined in the distribution surface of the insert are in fluid communication with the flow path and the distribution chamber for uniformly distributing a heat exchange fluid between the flow path and the flow tubes.

Accordingly, the present invention provides a heat exchanger assembly including an insert that provides a cost effective, flexible, and efficient solution for uniformly distributing and directing a heat exchange fluid to a plurality of flow tubes within the heat exchanger assembly. Uniform distribution of the heat exchange fluid prevents separation and distribution problems encountered in previous heat exchanger assemblies while increasing heat exchange performance of the heat exchanger assembly. The insert may include various configurations of the orifices. For example, the orifices may be different in size, shape and spacing. The insert may be made into any length for spanning a length or a portion of the length of the first single-piece manifold. The insert may easily be slid into, within, and from the first single-piece manifold for forming a plurality of configurations and passes within the heat exchanger assembly. The orifices and the distribution chamber efficiently and uniformly distribute the heat exchange fluid to each one of the flow tubes for increasing heat exchange performance of the heat exchanger assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a heat exchanger assembly is shown generally at 20.

Figure 1:
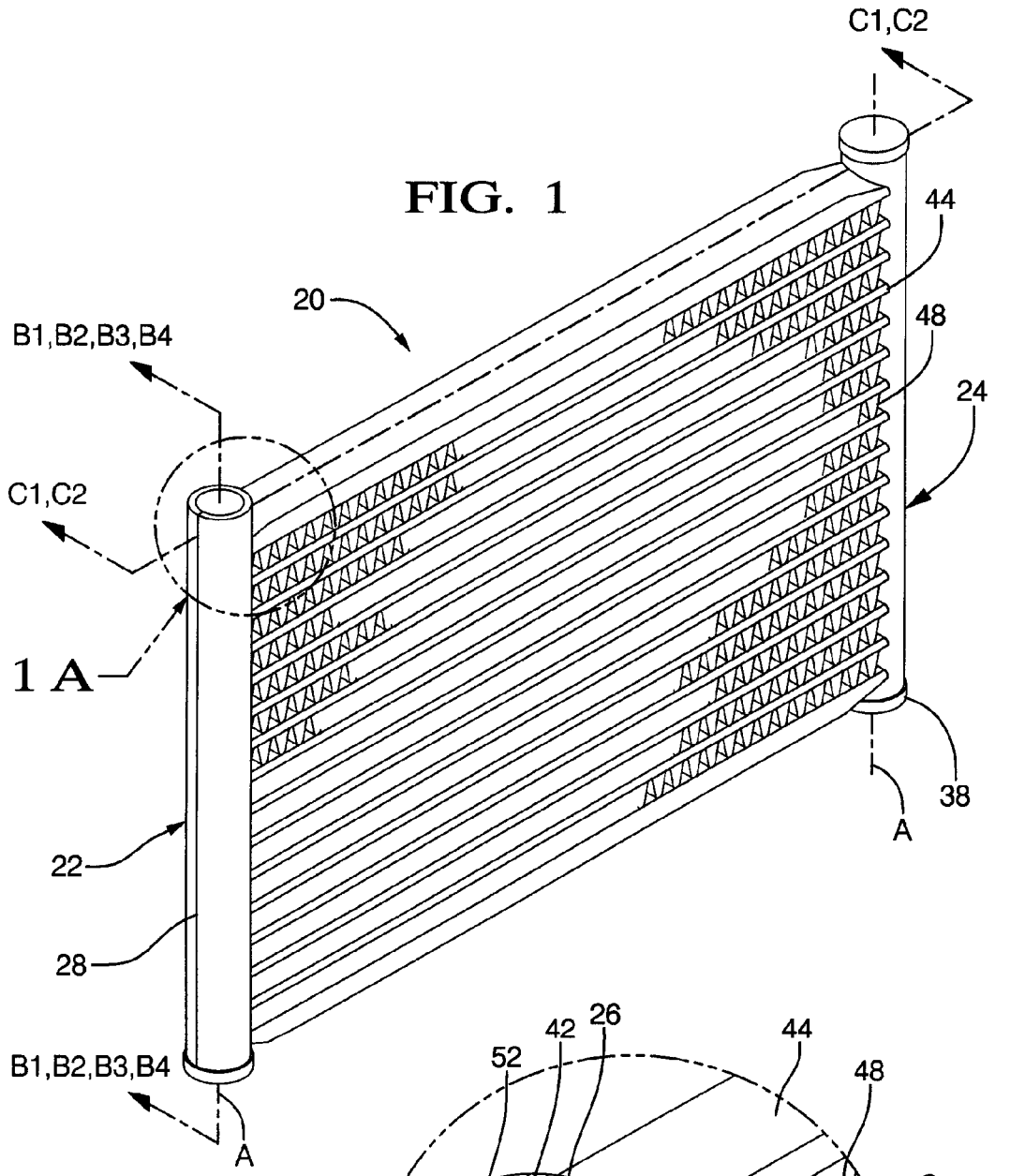
FIG. 1 is a perspective view of a heat exchanger assembly.

Referring to FIG. 1, a first embodiment of the heat exchanger assembly 20 is shown. The heat exchanger assembly 20 includes a first single-piece manifold 22 and a second single-piece manifold 24 spaced from and parallel to the first single-piece manifold 22. Referring to FIGS. 1A-6, each of the first and second single-piece manifolds 22, 24 (one shown) has a tubular wall 26 defining a flow path FP. In one embodiment, as best shown in FIGS. 2-6, the tubular wall 26 defines a circular shaped flow path FP. In other embodiments, the tubular wall 26 may define a triangular, an oval, a rectangular, a square, a polygon, or any other suitably shaped flow path FP as is known to those skilled in the art. The first and second single-piece manifolds 22, 24 may be used for receiving, holding, and distributing a heat exchange fluid. For simplicity, because the first and second single-piece manifolds 22, 24 may essentially be mirror images of each other, the first single-piece manifold 22 will now be further discussed in detail. As is known to those skilled in the art, the first single-piece manifold 22 may be commonly referred to as an inlet manifold, therefore performing an inlet function, and the second single-piece manifold 24 may be commonly referred to as an outlet manifold, therefore performing an outlet function, however, the opposite could be true. Reference to the first and second single-piece manifolds 22, 24 is interchangeable in the description of the subject invention.

Figure 1A:
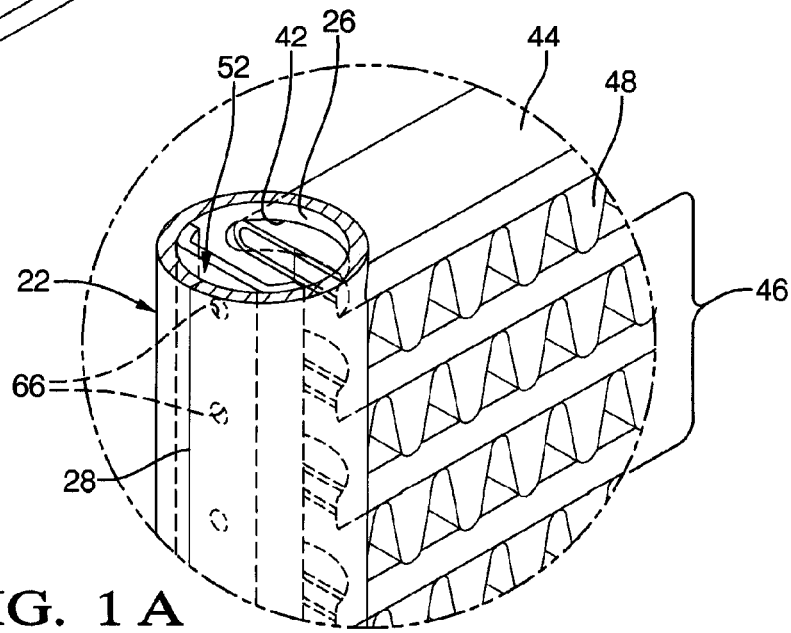
FIG. 1A is a magnified view of a portion of FIG. 1.

The tubular wall 26 may be formed by a suitable process as is known in the art. For example, the tubular wall 26 may be formed by an extrusion process or a welding process such as a roll forming and welding process. In one embodiment, as best shown in FIG. 1A, each of the tubular walls 26 of the first and second single-piece manifolds 22, 24 (one shown) includes a pair of longitudinal ends 28 adjacent and joined to each other such that each of the first and second single-piece manifolds 22, 24 are unitary. For example, the pair of longitudinal ends 28 may be joined to each other by a welding or brazing process. The tubular wall 26 may be formed from a suitable material as is known in the art. The material should be able to withstand temperatures and pressures encountered with use of the heat exchanger assembly 20 and, in addition, the material should be suitable for heat transfer as is known in the art. For example, the material may be selected from the group of metals, composites, polymers, plastics, ceramics, combinations thereof, or other suitable materials as are known to those skilled in the art. In one embodiment, the first and second single-piece manifolds 22, 24 are formed from the same material. In another embodiment, the first and second single-piece manifolds 22, 24 are each formed from a different material, respectively.

The heat exchanger assembly 20 further includes a first tube end 30 and a second tube end 32 spaced from the first tube end 30. In one embodiment, as best shown in FIGS. 7-10, the flow path FP extends between the tube ends 30, 32 of the first single-piece manifold 22.

Figure 16:
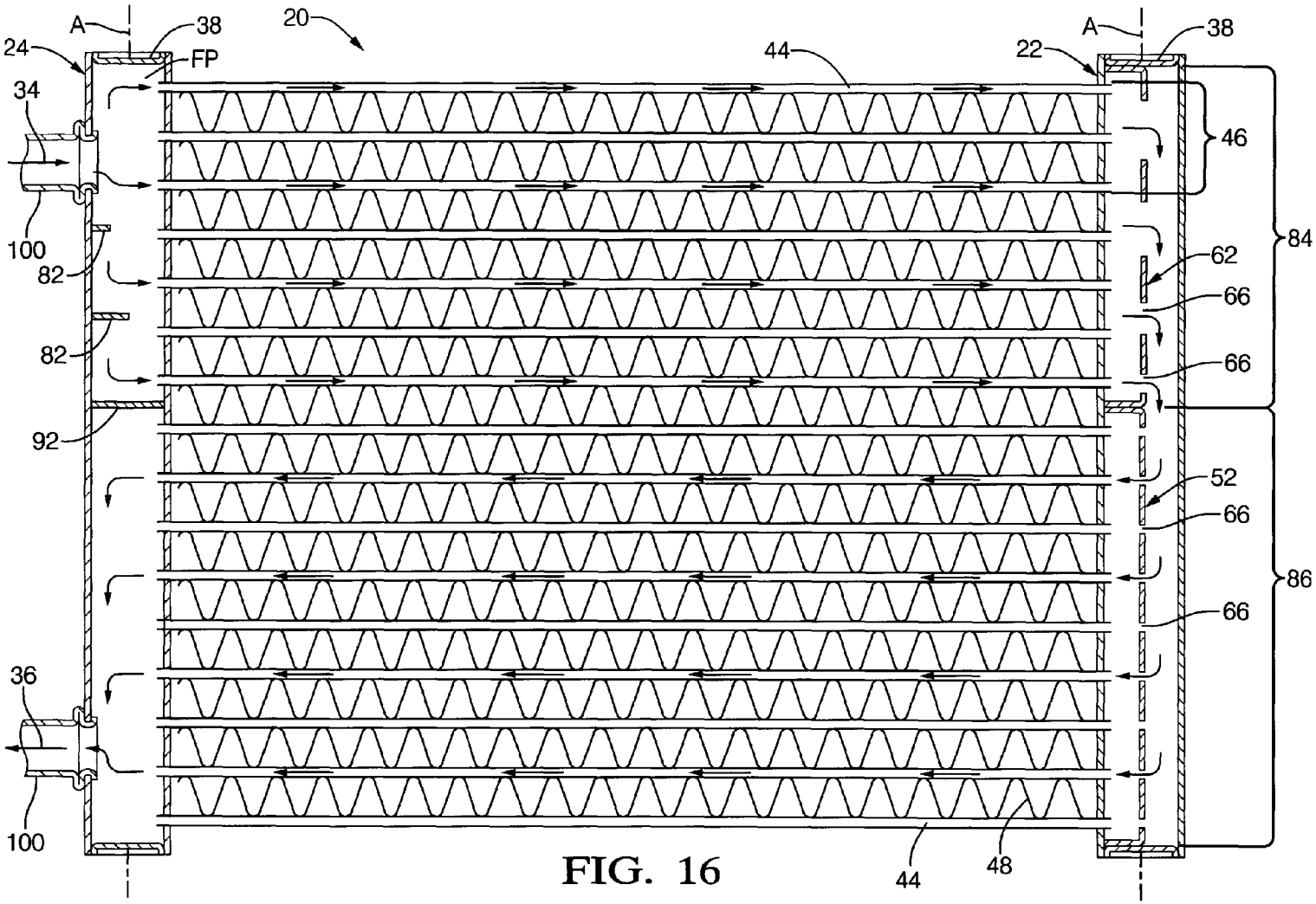
FIG. 16 is a cross-sectional side view of the heat exchanger assembly taken along line C1-C1 of FIG. 1.
Figure 17:
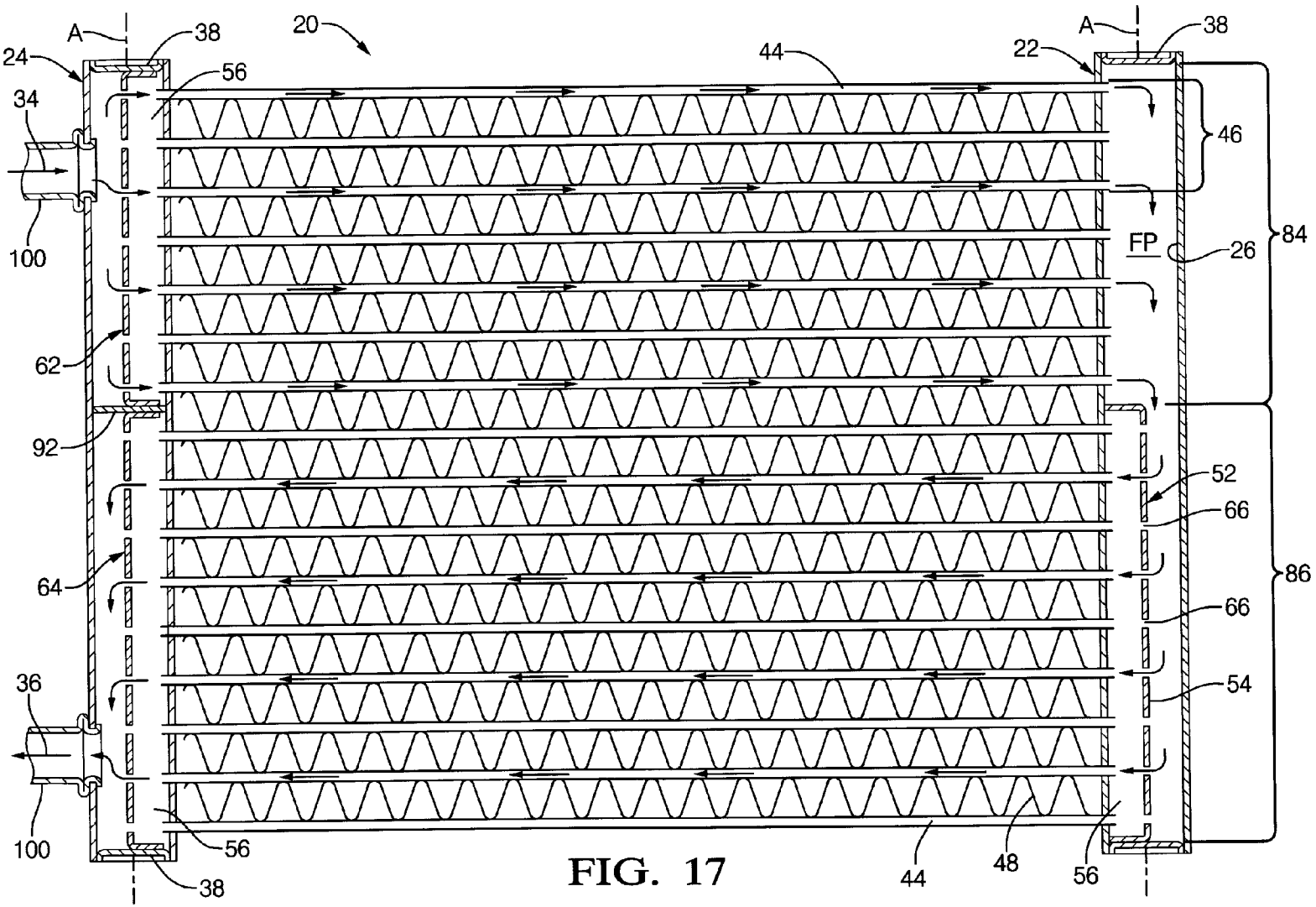
FIG. 17 is a cross-sectional side view of the heat exchanger assembly taken along line C2-C2 of FIG. 1.
Figure 18:
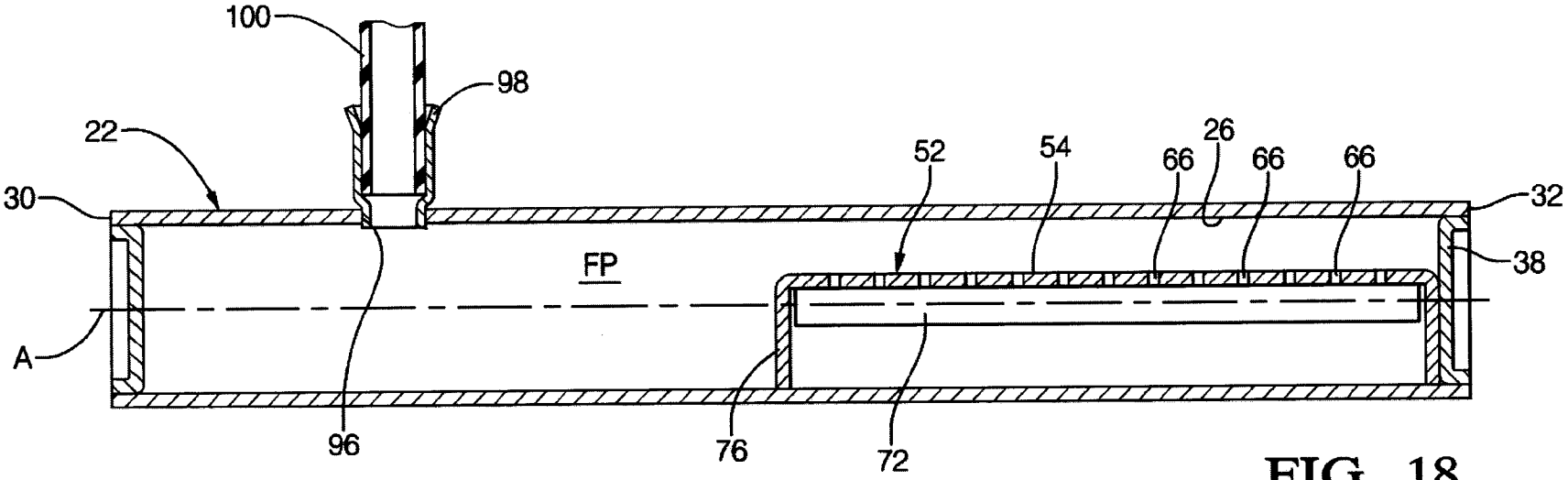
FIG. 18 is a cross-sectional side view of another embodiment the heat exchanger assembly and a coupler.
Figure 19:
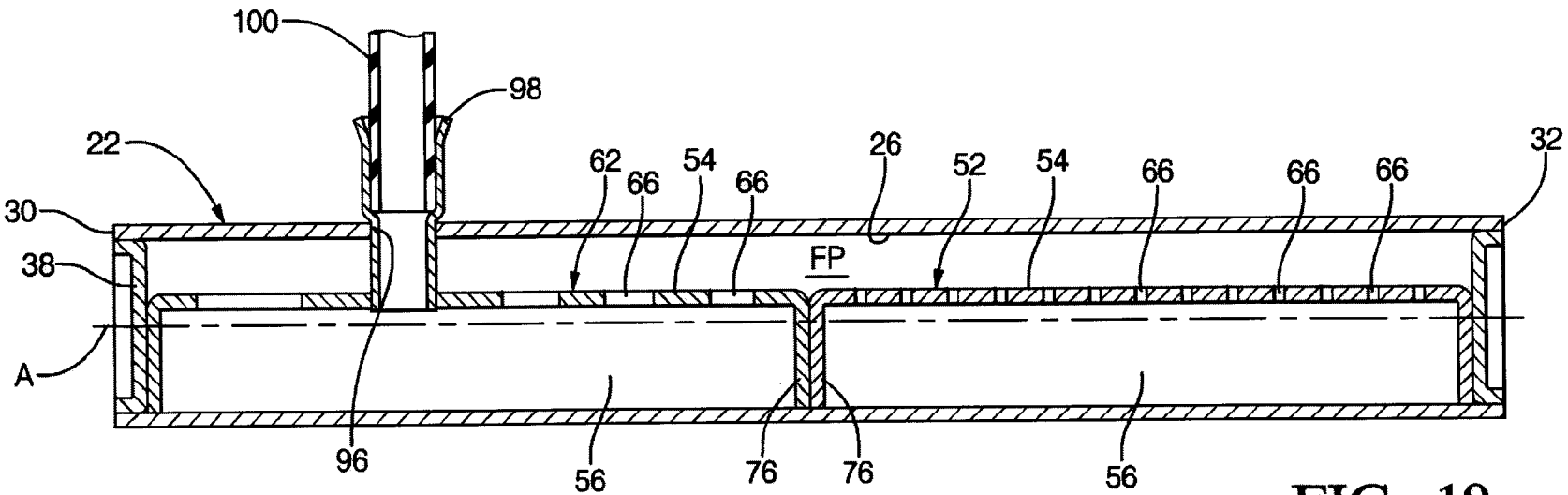
FIG. 19 is a cross-sectional side view of another embodiment of the heat exchanger assembly and another embodiment of the coupler.

The heat exchanger assembly 20 further includes at least one port 96 in fluid communication with the flow path FP. The port 96 may be of any size and shape. In one embodiment, the first single-piece manifold 22 defines the port 96. For example, one of the tube ends 30, 32 may define the port 96. As another example, and as shown in FIGS. 18 and 19, the tubular wall 26 may define the port 96 between the tube ends 30, 32. In one embodiment, the port 96 is an inlet 34. In another embodiment, the port 96 is an outlet 36. In one embodiment, as best shown in FIGS. 16 and 17, the inlet 34 and the outlet 36 are disposed in the tubular wall 26 of the second single-piece manifold 24. In another embodiment, the inlet 34 and the outlet 36 are both disposed in the tubular wall 26 of the first single-piece manifold 22. In yet another embodiment, the inlet 34 is disposed in one of the single-piece manifolds 22, 24 and the outlet 36 is disposed in the other single-piece manifold 22, 24. The inlet 34 and the outlet 36 may be used for feeding and drawing the heat exchange fluid to and from the heat exchanger assembly 20, respectively, as is known to those skilled in the art.

As best shown in FIGS. 2-6, the heat exchanger assembly 20 further includes an axis A-A extending centrally within the flow path FP of the first single-piece manifold 22, a center plane CP intersecting the axis A-A between the tubular wall 26, and a width W defined within the tubular wall 26.

Figure 7:
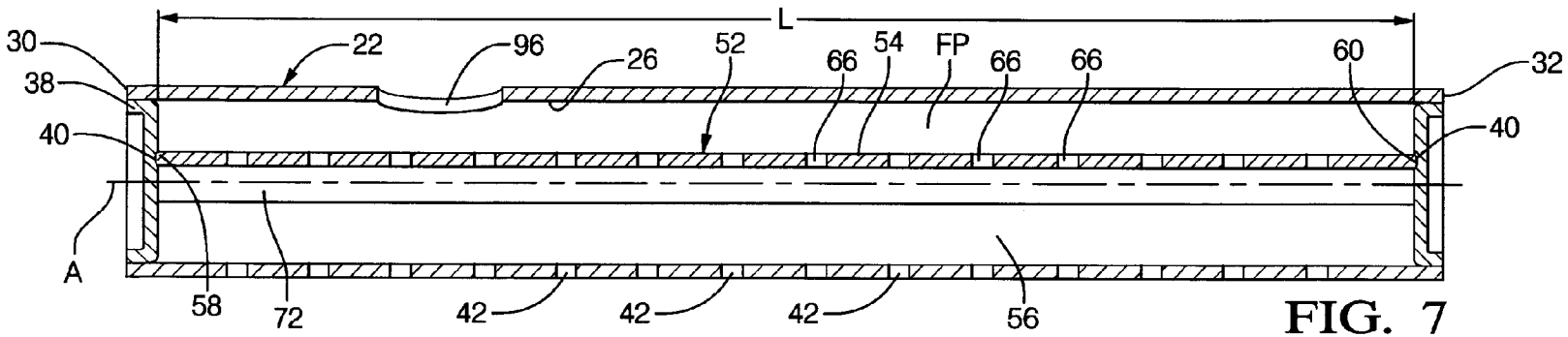
FIG. 7 is a cross-sectional side view of another embodiment of the heat exchanger assembly taken along line B1-B1 of FIG. 1.
Figure 8:
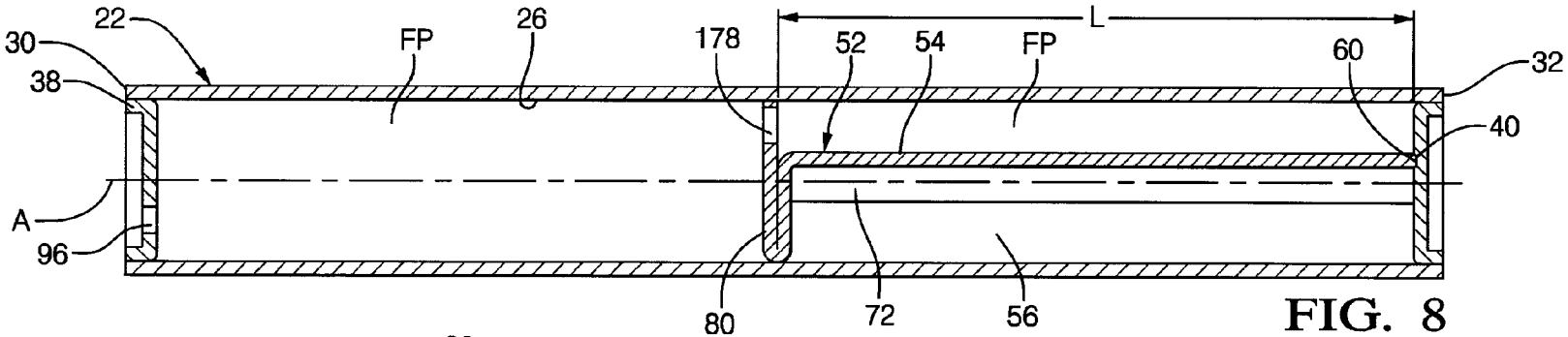
FIG. 8 is a cross-sectional side view of the heat exchanger assembly taken along line B2-B2 of FIG. 1.
Figure 9:
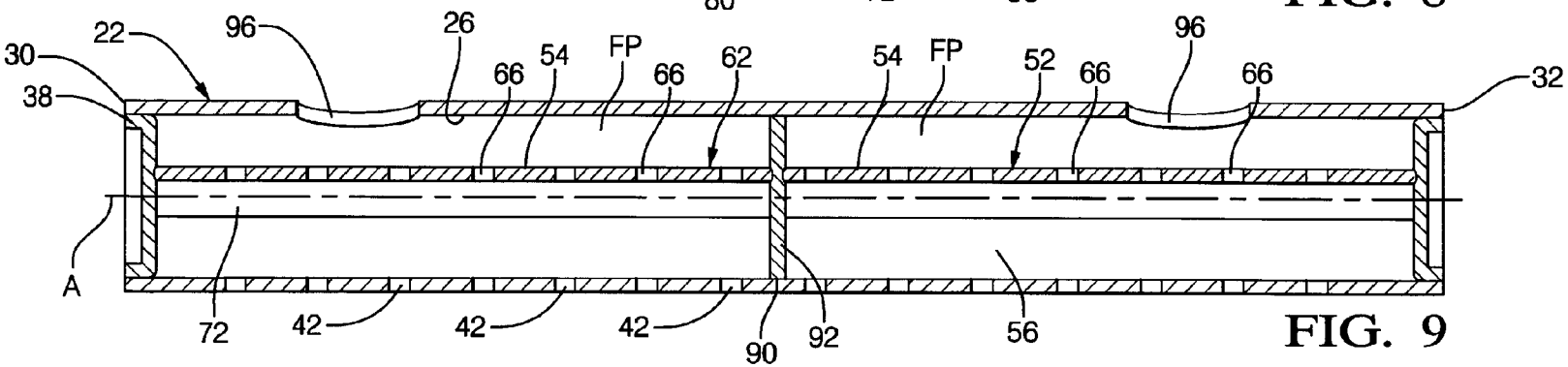
FIG. 9 is a cross-sectional side view of the heat exchanger assembly taken along line B3-B3 of FIG. 1.
Figure 10:
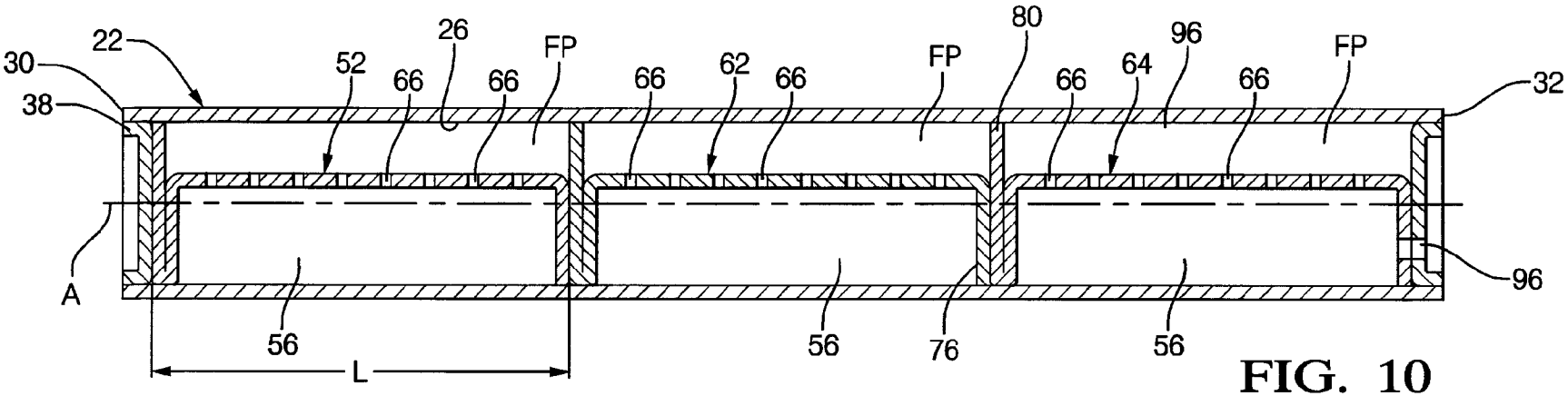
FIG. 10 is a cross-sectional side view of the heat exchanger assembly taken along line B4-B4 of FIG. 1.

The heat exchanger assembly 20 may include a plurality of end caps 38. In one embodiment, as shown in FIG. 1, one of the end caps 38 is disposed over each one of the tube ends 30, 32 (except at portion 1A). In another embodiment, as best shown in FIGS. 7-10, a pair of the end caps 38 is disposed within the flow path FP between the tubular wall 26, with each one of the end caps 38 proximal to each one of the tube ends 30, 32. As shown in FIGS. 7 and 8, the end cap 38 may define a notch 40. As shown in FIG. 10, the end cap 38 may define the port 96. It should be appreciated that the end cap 38 with the port 96 may also be used for the inlet 34 or the outlet 36. The end caps 38 may be formed from a suitable material as is known in the art. The material may be the same or different than the material of the tubular wall 26. The end caps 38 may be used for sealing off the first and second single-piece manifolds 22, 24 to form a closed system for the heat exchanger assembly 20. The end caps 38 may be sealed onto or within the tube ends 30, 32 by any method as is known in the art, such as by brazing, welding, gluing, or crimping the end caps 38 in place.

The heat exchanger assembly 20 further includes a series of apertures 42 disposed in the tubular wall 26 of the first and second single-piece manifolds 22, 24. In one embodiment, as best shown in FIG. 1A, each of the apertures 42 are equally sized, shaped, and spaced. In other embodiments, the apertures 42 may be of different sizes, shapes, and/or spacing. Each one of the apertures 42 may be the same or different than the other apertures 42. The apertures 42 may be formed in the tubular wall 26 by any process as is known in the art, such as by cutting, drilling, or punching the tubular wall 26. The apertures 42 may be used for communicating the heat exchange fluid to and from the first and second single-piece manifolds 22, 24.

As best shown in FIG. 1, the heat exchanger assembly 20 further includes a plurality of flow tubes 44 extending in parallel between the first and second single-piece manifolds 22, 24. The flow tubes 44 are in fluid communication with the flow paths FP. The flow tubes 44 may define any suitable shape. In one embodiment, as shown in FIG. 1A, each of the flow tubes 44 is substantially rectangular with round edges. In other embodiments, the flow tubes 44 may be circular, triangular, square, polygon, or any other suitable shape as known to those skilled in the art. Each one of the flow tubes 44 may be same or different than the other flow tubes 44. In one embodiment, the flow tubes 44 extend through the apertures 42 of the tubular wall 26 and partially into the flow path FP. In another embodiment, the flow tubes 44 extend through the apertures 42 and stop short of the flow path FP. In yet another embodiment, the flow tubes 44 extend to and contact the tubular wall 26 in alignment with the apertures 42. In one embodiment, as best shown in FIG. 16, the flow tubes 44 are grouped into a plurality of flow tube groups 46. For clarity, the flow tube group 46 includes at least two of the flow tubes 44. The flow tubes 44 may be formed from a suitable material as is known in the art. The material may be the same or different than the material of the tubular wall 26. The flow tubes 44 may be attached to the first and second single-piece manifolds 22, 24 by any process known in the art, such as by brazing, welding, gluing, or pressing the flow tubes 44 to the first and second single-piece manifolds 22, 24. The flow tubes 44 may be used for communicating the heat exchange fluid between the first and second single-piece manifolds 22, 24. The flow tubes 44 may also be used for transferring heat to or from ambient air surrounding the flow tubes 44.

The flow tubes 44 may be formed by any method or process as is known in the art. For example, the flow tubes 44 may be formed by an extrusion process or a welding process. In one embodiment, as shown in FIG. 1A, each one of the flow tubes 44 may define a passage therein. In another embodiment, each one of the flow tubes 44 defines a plurality of passages therein. The passages may be in fluid communication with the flow paths FP of the first and second single-piece manifolds 22, 24. The passages may be any suitable shape and size. For example, the passages may be circular, oval, triangular, square, or rectangular in shape. Each one of the passages may be the same or different than the other passages. The passages may be used for decreasing a volume to surface area ratio of the heat exchange fluid within the flow tube 44 for increasing overall heat exchange performance of the heat exchanger assembly 20.

The heat exchanger assembly 20 may further include a plurality of air fins 48. In one embodiment, the airs fins 48 are disposed on each one of the flow tubes 44. In another embodiment, as best shown in FIGS. 1 and 1A, the air fins 48 are disposed between the flow tubes 44 and the first and second single-piece manifolds 22, 24. The air fins 48 may be disposed on or between the flow tubes 44 in any arrangement known in the art, such as a corrugated fin or stacked plate fin arrangement. The air fins 48 may be formed from any suitable material as is known in the art. The material may be the same or different than the material of the tubular wall 26. The air fins 48 may be attached to the flow tubes 44 by any process known in the art, such as by brazing, welding, gluing, or pressing the air fins 48 onto or between the flow tubes 44. The air fins 48 may be used for increasing surface area of the flow tubes 44 which increases heat exchange performance of the heat exchanger assembly 20.

Figure 4:
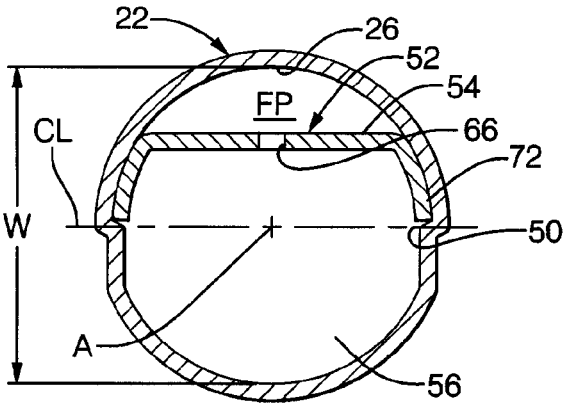
FIG. 4 is a cross-sectional side view of another embodiment of the first single-piece manifold and another embodiment of the insert disposed therein.
Figure 5:
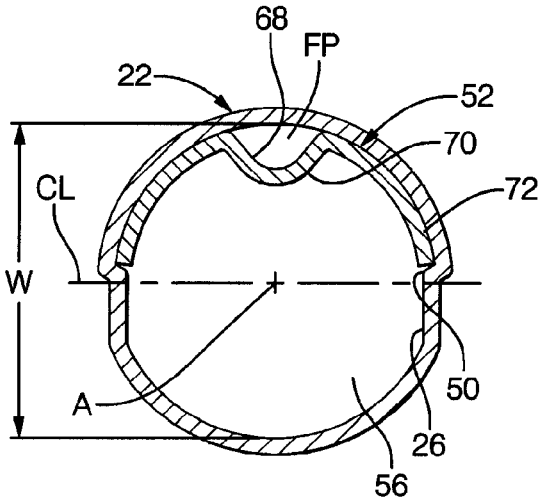
FIG. 5 is a cross-sectional side view of another embodiment of the first single-piece manifold and another embodiment of the insert disposed therein.
Figure 6:
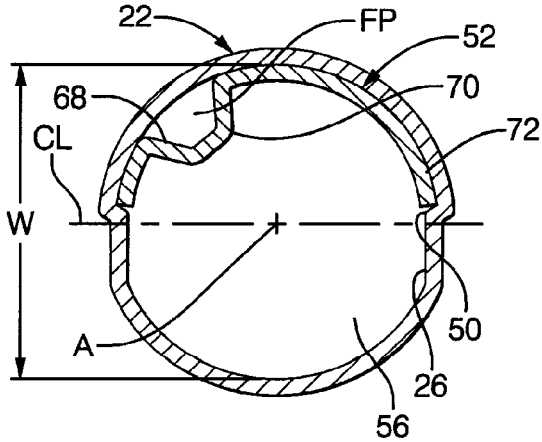
FIG. 6 is a cross-sectional side view of another embodiment of the first single-piece manifold and another embodiment of the insert disposed therein.

The heat exchanger assembly 20 may further include at least two indentations 50. In one embodiment, as shown in FIGS. 4-6, the tubular wall 26 of the first single-piece manifold 22 defines a pair of the indentations 50 with each indentation 50 spaced from and opposite the other. In another embodiment, the heat exchanger assembly 20 may include a plurality of the indentations 50. For example, the first single-piece manifold 22 may include one pair of indentations 50 for each one of the apertures 42 or flow tubes 44. It should be appreciated that the indentations 50 may be in various locations and configurations. For example, the indentations 50 may run a length of the flow path FP in a series, may be connected and span an entire length of the flow path FP, or may be individual and discrete elements. The indentations 50 may be formed by any method or process known in the art, such as by extruding, pressing, crimping, or punching the tubular wall 26 of the first single-piece manifold 22.

The heat exchanger assembly 20 further includes an insert 52 having a distribution surface 54. As best shown in FIGS. 16 and 17, the insert 52 is slidably disposed in the flow path FP of the first single-piece manifold 22 to establish a distribution chamber 56 within the first single-piece manifold 22. In one embodiment, the insert 52 is removable from the flow path FP of the first single-piece manifold 22. For example, the insert 52 may be slidably removable from the flow path FP for changing orientation and location of the distribution chamber 56 or for cleaning the tubular wall 26 of the first single-piece manifold 22. In another embodiment, the insert 52 is fixed in the flow path FP of the first single-piece manifold 22. For example, the insert 52 may be fixed by brazing, welding, gluing, pressing, or crimping the insert 52 to the tubular wall 26 in the flow path FP of the first single-piece manifold 22 to permanently maintain the orientation and location of the distribution chamber 56. In yet another embodiment, the insert 52 may be movable in the flow path FP. For example, the insert 52 may be slidably moveable for forming a plurality of configurations and passes within the heat exchanger assembly 20. It should be appreciated that the insert 52 may be slidably removable from, slidably movable in, or fixed in the flow path FP of either one of the first and second single-piece manifolds 22, 24. The insert 52 may be formed from any suitable material as is known in the art. The material should be able to withstand temperatures and pressures encountered in the first single-piece manifold 22. The material may be the same or different than the material of the tubular wall 26. It should also be appreciated that the insert 52 may be slidably disposed in the flow path FP before or after the heat exchanger assembly 20 is fully assembled. For example, the insert 52 may be slidably disposed in the flow path FP of the first single-piece manifold 22 after the flow tubes 44 are attached to the first and second single-piece manifolds 22, 24. It should also be appreciated that the distribution surface 54 does not need to be parallel to the flow tubes 44 and may be at an angle.

The insert 52 may be formed by any method or process as is known in the art. For example, the insert 52 may be formed by an extrusion process, a welding process, a stamping process, a roll-forming process, or other methods and processes known to those skilled in the art. The insert 52 may be of any thickness.

Figure 12:
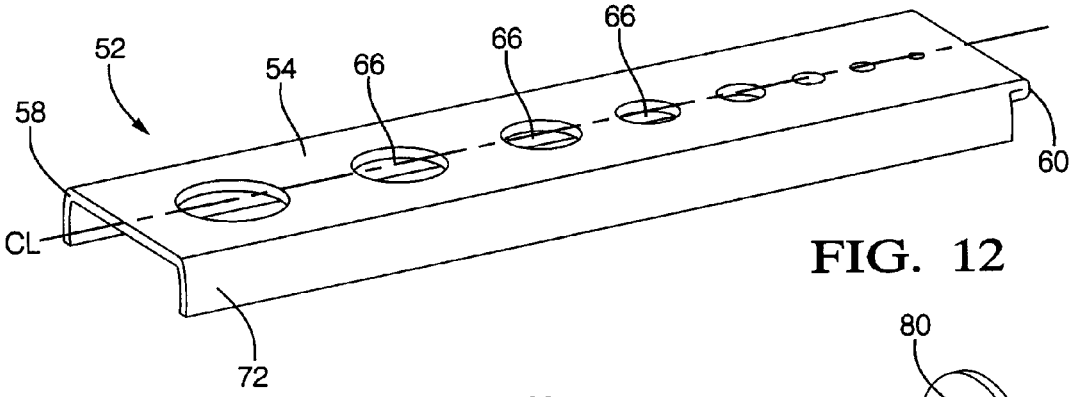
FIG. 12 is a perspective view of another embodiment of the insert.

As best shown in FIGS. 7 and 12, the distribution surface 54 of the insert 52 includes a first insert end 58 and a second insert end 60 spaced from the first insert end 58. An insert length L extends between the insert ends 58, 60. In one embodiment, as shown in FIG. 8, the insert length L is less than the flow path FP of the first single-piece manifold 22. In another embodiment, as shown in FIG. 7, the insert length L is equal to the flow path FP of the first single-piece manifold 22. In yet another embodiment (not shown), the insert length L is greater than the flow path FP of the first single-piece manifold 22. This often occurs when the end caps 38 are disposed over each one of the tube ends 30, 32 and the insert ends 58, 60 abut the end caps 38. It should be appreciated that the insert length L may be any length equal to, less than, or greater than the flow path FP. As best shown in FIGS. 7-9, the insert ends 58, 60 may mechanically engage the notches 40 of the end caps 38 for orienting and securing the insert 52 in the flow path FP and for further defining the distribution chamber 56. In other embodiments, the insert ends 58, 60 may mechanically engage other features of the end caps 38 formed therein or extending therefrom such as a lip.

Referring to FIGS. 9, 16 and 17, the heat exchanger assembly 20 may further include a second insert 62 having a distribution surface 54. The second insert 62 may be slidably disposed in the flow path FP of one of the first and second single-piece manifolds 22, 24 to establish the distribution chamber 56 within one of the first and second single-piece manifolds 22, 24. The second insert 62 may be slidably removable from, slidably movable in, or fixed in the flow path FP of one of the first and second single-piece manifolds 22, 24. The second insert 62 may the same or different than the insert 52. It should be appreciated that in other embodiments, the heat exchanger assembly 20 may include three or more inserts slidably disposed in the flow path FP of one of the first and second single-piece manifolds 22, 24. For example, as shown in FIG. 10, a third insert 64 is slidably disposed in the flow path FP along with the insert 52 and the second insert 62.

Figure 2:
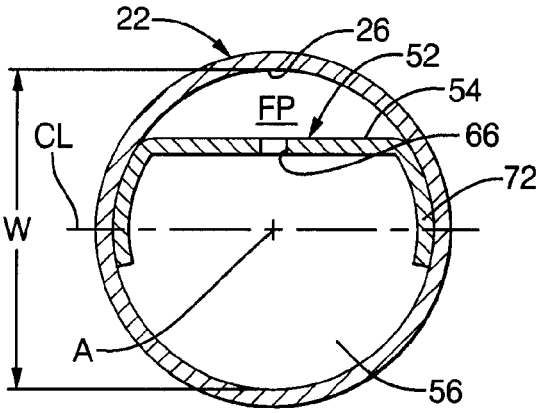
FIG. 2 is a cross-sectional side view of a first single-piece manifold and an insert disposed therein.
Figure 3:
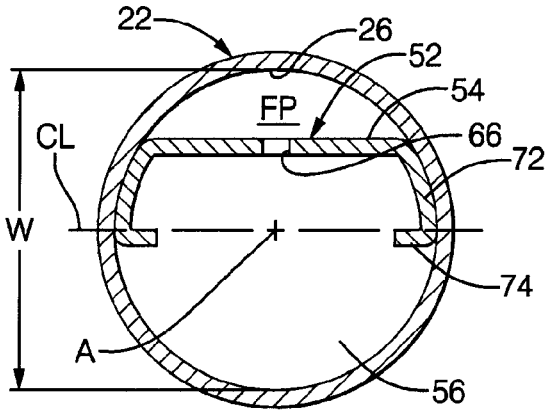
FIG. 3 is a cross-sectional side view of the first single-piece manifold and another embodiment of the insert disposed therein.

The insert 52 may be oriented in any suitable position in the flow path FP. As best shown in FIGS. 2-4, the distribution surface 54 of the insert 52 is spaced from and parallel to the center plane CP. The second insert 62 may also be oriented in any suitable position in the flow path FP. In one embodiment, as shown in FIG. 16, the second insert 62 is slidably disposed in the flow path FP of the first single-piece manifold 22 along with the insert 52. In another embodiment, as shown in FIG. 17, the second insert 62 is slidably disposed in the flow path FP of the second single-piece manifold 24. In addition, as also shown in FIG. 17, the third insert 64 may also be slidably disposed in one of the first and second manifolds 22, 24.

As best shown in FIGS. 11-15, the heat exchanger assembly 20 further includes a series of orifices 66 defined in the distribution surface 54 of the insert 52 and in fluid communication with the flow path FP and the distribution chamber 56. The orifices 66 are for uniformly distributing the heat exchange fluid between the flow path FP and the flow tubes 44. The distribution of the heat exchange fluid to the distribution chamber 56 and then to the flow tubes 44 may be used for increasing heat exchange performance of the heat exchanger assembly 20 and may also be used to solve distribution and separation problems of the heat exchange fluid as encountered in previous heat exchanger assemblies. In one embodiment, as shown in FIGS. 16 and 17, the orifices 66 are in alignment with the flow tubes 44 with one of the orifices 66 aligned per at least one of the flow tubes 44. In another embodiment, as also shown in FIG. 17, the orifices 66 are in alignment with the flow tube groups 46 with one of the orifices 66 aligned per at least one of the flow tube groups 46. It should be appreciated that the heat exchanger assembly 20 may further include a series of orifices 66 defined in the distribution surface 54 of the second and third inserts 62, 64 and in fluid communication with the flow path FP and the distribution chamber 56. It should also be appreciated that the orifices 66 may be offset from the flow tubes 44 and flow tube groups 46. As shown in FIG. 18, the port 96 may be in direct fluid communication with the distribution chamber 56, and optionally, the flow path FP.

Figure 11:
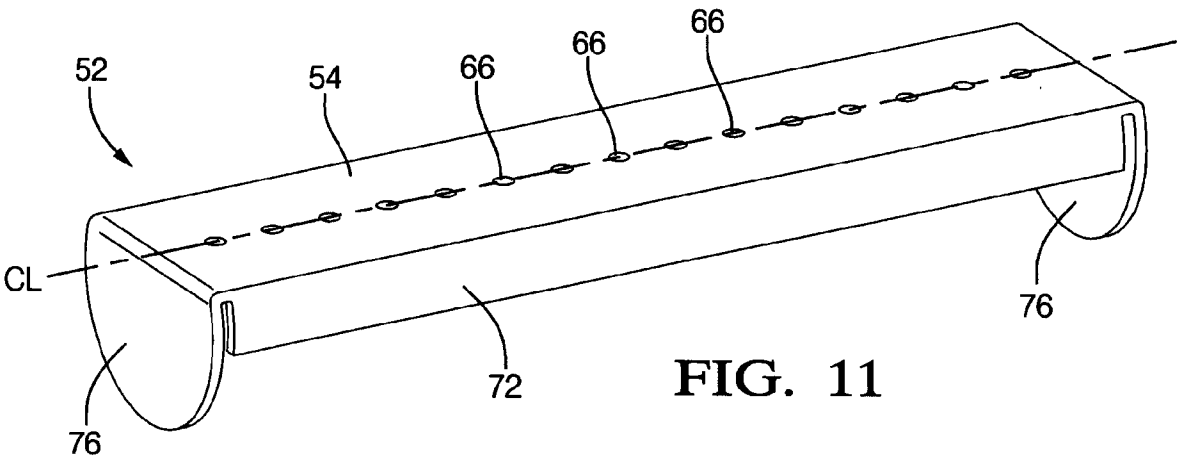
FIG. 11 is a perspective view of another embodiment of the insert.
Figure 13:
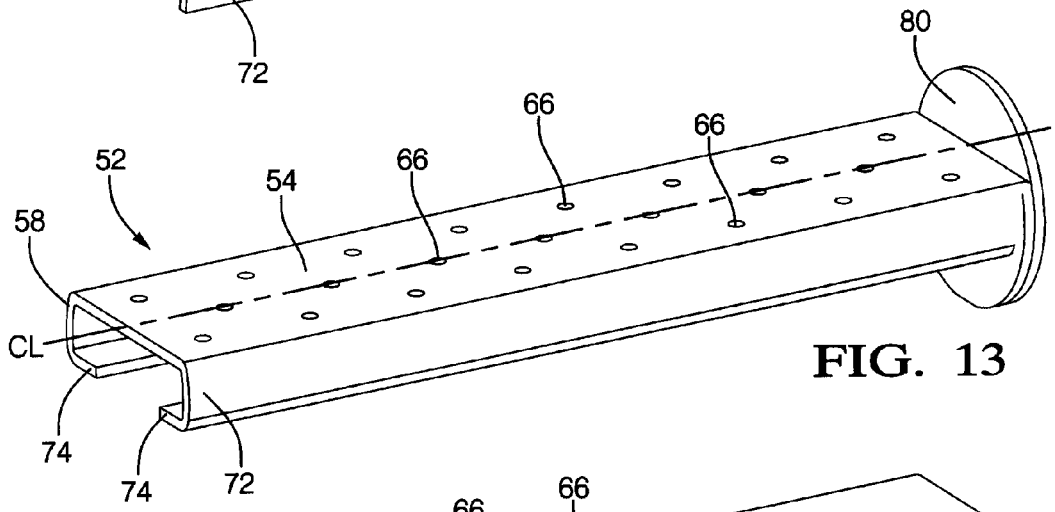
FIG. 13 is a perspective view of another embodiment of the insert.
Figure 14:
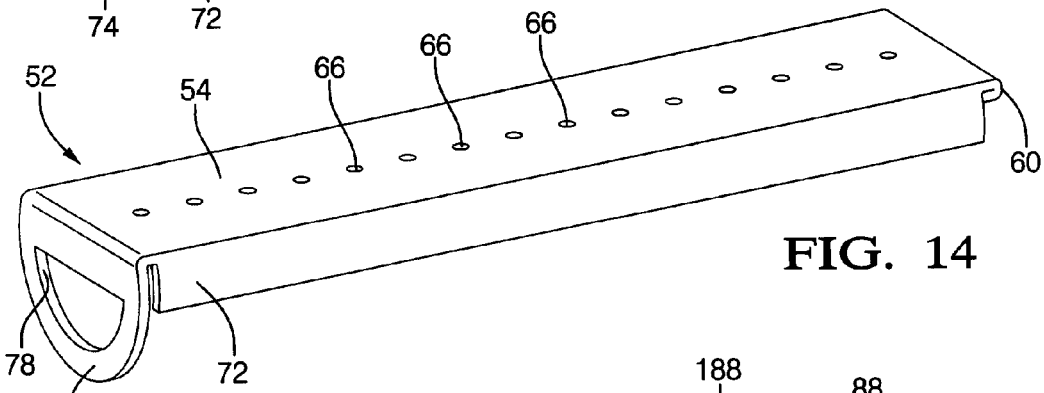
FIG. 14 is a perspective view of another embodiment of the insert.
Figure 15:
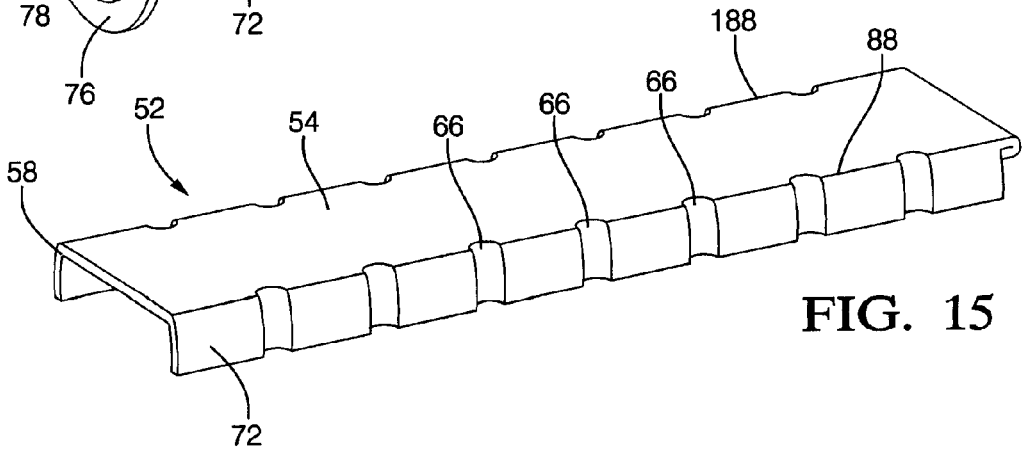
FIG. 15 is a perspective view of another embodiment of the insert.

As best shown in FIGS. 11-15, the heat exchanger assembly 20 further includes a center line CL parallel to the axis A-A extending along the distribution surface 54 of the insert 52. The orifices 66 may be spaced from each other along the center line CL of the distribution surface 54 of the insert 52 in any suitable pattern. In one embodiment, the orifices 66 are offset from the center line CL. In another embodiment, as best shown in FIGS. 11 and 14, the orifices 66 are equally spaced from each other along the center line CL of the distribution surface 54 of the insert 52. In yet another embodiment, as shown in FIG. 13, the orifices 66 are spaced from each other and from the center line CL of the distribution surface 54 of the insert 52. In yet another embodiment, the orifices 66 are spaced from each other and from the center line CL and are at least partially defined along an edge 88 of the distribution surface 54 of the insert 52. As shown in FIG. 15, the orifices 66 are defined along an opposite edge 188 of the distribution surface 54 and along the edge 88. It should be appreciated that the orifices 66 may define any suitable shape, may be any size, and may have any spacing relative to one another. For example, in one embodiment, as shown in FIG. 12, the orifices 66 define circles which decrease in diameter from the first insert end 58 to the second insert end 60. In other embodiments, the orifices 66 may define an oval, a rectangular, a triangular, or a square shape. It should be appreciated that each one of the orifices 66 may be the same or different than the other orifices 66.

The heat exchanger assembly 20 may further include a groove 68. In one embodiment, as shown in FIGS. 5 and 6, a portion of the distribution surface 54 is concave and forms the groove 68 therein bounded by a bottom surface 70 spaced from the tubular wall 26 of the first single-piece manifold 22. The groove 68 may be defined along the center line CL of the distribution surface 54 of the insert 52. In another embodiment, as shown in FIG. 6, the groove 68 is offset from the center line CL of the distribution surface 54 of the insert 52. In one embodiment, the orifices 66 are defined in the bottom surface 70 along the groove 68 of the distribution surface 54 of the insert 52. In another embodiment, the orifices 66 are defined in the distribution surface 54 offset from the groove 68.

The heat exchanger assembly 20 may further include a pair of side flanges 72 extending opposite each other from the distribution surface 54 of the insert 52 toward and along the tubular wall 26 of the first single-piece manifold 22. In one embodiment, as shown in FIG. 1A, the side flanges 72 and the tubular wall 26 are complimentary curved such that the side flanges 72 mechanically engage the tubular wall 26. In another embodiment, as shown in FIG. 2, each of the side flanges 72 extend from the distribution surface 54 along the tubular wall 26 toward and across the center plane CP. This embodiment is especially useful for orienting and securing the insert 52 in the flow path FP. The side flanges 72 may be used for orienting and securing the insert 52 in the flow path FP of the first single-piece manifold 22. In yet another embodiment, as best shown in FIGS. 4-6, the side flanges 72 mechanically engage the indentations 50 for orienting and securing the insert 52 in the flow path FP of the first single-piece manifold 22. Referring to FIG. 15, the said flanges 72 may at least partially define the orifices 66 along the edges 88, 188 of the distribution surface 54 of the insert 52.

The heat exchanger assembly 20 may further include a pair of tips 74 with each tip 74 spaced from and opposite the other with one of the tips 74 curving to extend from one of the side flanges 72 parallel to the distribution surface 54 of the insert 52 and the other of the tips 74 curving to extend from the other of the side flanges 72 parallel to the distribution surface 54 of the insert 52. As shown in FIG. 3, one of the flow tubes 44 extends toward the center plane CP and mechanically engages the tips 74 of the insert 52. The tips 74 may also be used for properly orienting the insert 52 in the flow path FP. For example, the insert 52 may be oriented by extending the flow tube 44 into the flow path FP and contacting one of the tips 74 to rotate the insert 52 until the flow tube 44 contacts the other tip 74. The flow tube 44 may then be retracted from the flow path FP. It is to be appreciated that the tips 74 may be at any angle relative to the distribution surface 54 and are not limited to being parallel to the distribution surface 54. For example, the tips 74 may extend towards or away from the distribution surface. In addition, each one of the tips 74 may be at a different angle from the other such that they are not mirror images of one another.

The heat exchanger assembly 20 may further include at least one partial separator 76 integrally extending from the distribution surface 54 of the insert 52 outwardly toward the tubular wall 26 of the first single-piece manifold 22 such that the partial separator 76 obstructs a portion of the width W of the first single-piece manifold 22. In one embodiment, as shown in FIG. 11, the partial separator 76 is solid. In another embodiment, as shown in FIG. 14, the partial separator 76 defines a hole 78. It should be appreciated that the partial separator 76 may extend outwardly toward the tubular wall 26 in any direction. In addition, the partial separator 76 may define a plurality of holes 78. The partial separator 76 plate may be used for directing the heat exchange fluid to the orifices 66 and/or the flow tubes 44 and for forming a plurality of configurations and passes within the heat exchanger assembly 20.

The heat exchanger assembly 20 may further include at least one full separator 80 integrally extending from the distribution surface 54 of the insert 52 outwardly toward and to the tubular wall 26 of the first single-piece manifold 22 such that the full separator 80 obstructs an entirety of the width W of the first single-piece manifold 22. In one embodiment, as shown in FIG. 13, the full separator 80 is attached to the insert 52. In another embodiment, as shown in FIG. 10, the full separator 80 folds upon itself to obstruct the entirety of the width W. As shown in FIG. 8, the full separator 80 may define one or more holes 178. The full separator 80 may be used for directing the heat exchange fluid to orifices 66 and/or the flow tubes 44 and for forming a plurality of configurations and passes within the heat exchanger assembly 20.

As shown in FIG. 16, the heat exchanger assembly 20 may further include at least one partial baffle 82 slidably disposed in the flow path FP. The partial baffle 82 has a perimeter 90 with only a portion of the perimeter 90 contacting the tubular wall 26 of the first single-piece manifold 22 such that the partial baffle 82 obstructs a portion of the width W of the first single-piece manifold 22. The partial baffle 82 may be used for directing the heat exchange fluid to the orifices 66 and/or the flow tubes 44 and for forming a plurality of configurations and passes within the heat exchanger assembly 20.

As shown in FIG. 16, the heat exchanger assembly 20 may further include at least on full baffle 92 slidably disposed in the flow path FP. The full baffle 92 has a perimeter 90 with an entirety of the perimeter 90 contacting the tubular wall 26 of the first single-piece manifold 22 such that the full baffle 92 obstructs an entirety of the width W of the first single-piece manifold 22. The full baffle 92 may be used for directing the heat exchange fluid to the orifices 66 and/or the flow tubes 44 and for forming a plurality of configurations and passes within the heat exchanger assembly 20. It should be appreciated that the baffles 82, 92 may be slid into the flow path FP through one of the tube ends 30, 32, one of the apertures 42, or a slit (not shown) in the tubular wall 26.

The baffles 82, 92 may define a notch 140. In one embodiment, as shown in FIG. 9, the insert ends 58, 60 mechanically engage the notch 140 for orienting and securing the insert 52 and the full baffle 82 in the flow path FP and for further defining the distribution chamber 56. In another embodiment, as shown in FIG. 13, one of the first insert ends 58, 60 may be attached to one of the baffles 82, 92 by, for example, brazing, pressing, or welding. The baffles 82, 92 may be shaped and sized to compliment the shape of the flow path FP. The baffles 82, 92 may define a plurality of holes. The baffles 82, 92 may be removable from, movable in, or fixed in the flow path FP. For example, the indentations 50 may mechanically engage the baffles 82, 92 to hold the baffles 82, 92 in place, or optionally, the baffles 82, 92 may be brazed, welded, or glued in place. The baffles 82, 92 may be formed from any suitable material as is known in the art. The material may be the same or different than the material of the tubular wall 26. The baffles 82, 92 are useful for forming a plurality of configurations and passes in the heat exchanger assembly 20.

The heat exchanger assembly 20 may further include a coupler 98 disposed in the port 96. In one embodiment, as shown in FIG. 18, the coupler 98 is disposed in the port 96 and is in direct fluid communication with the flow path FP. In another embodiment, as shown in FIG. 19, the coupler 98 is disposed in the port 96 and is in direct fluid communication with the distribution chamber 56. In yet another embodiment (not shown), the coupler 98 is disposed in the port 96 and is in direct fluid communication with both the flow path FP and the distribution chamber 56. As alluded to above, the port 96 may be defined by the tubular wall 26 between the tube ends 30, 32, as shown in FIGS. 18 and 19, may be defined by the end cap 38, as shown in FIGS. 8 and 10, or may be defined by the tube ends 30, 32. The coupler 98 may be disposed in various configurations and locations dependent on location of the port 96. In addition, the coupler 98 may extend into the flow path FP, the distribution chamber 56, or both the flow path FP and the distribution chamber 56 at various depths. For example, the coupler 98 may extend through the tubular wall 26 and into the flow path FP and, optionally, though one of the orifices 66 of the insert 52 and into the distribution chamber 56. The coupler 98 may be formed from any suitable material as is known in the art. The material may be the same or different than the material of the tubular wall 26. The coupler 98 is useful for coupling an external tube 100 to the first single-piece manifold 22. The external tube 100 may be any external plumbing as known in the art such as an inlet pipe or an outlet pipe for communicating the heat exchange fluid to and from the heat exchanger assembly 20, respectively. The coupler 98 is especially useful during manufacture of the heat exchanger assembly 20. For example, a plurality of the port 96 may be made in any location in the first single piece manifold 22, the second single-piece manifold 24, and/or the end caps 38. The coupler 98 may then be slidably disposed in the port 96 at various locations and then, optionally, fixed in place such as by crimping, brazing or welding. Alternatively, the external tube 100 may be pushed into the coupler 98 such that the coupler 98 expands and mechanically seals within the port 96. As previously alluded to above, the coupler 98 may be in fluid communication with the flow path FP, the distribution chamber 56, or a combination of both the flow path FP and the distribution chamber 56. By sliding the coupler 98 into the various positions, i.e., depths, in the port 96, introduction or removal of the heat exchange fluid to or from the heat exchanger assembly 20, respectively, can be better controlled. This allows for better distribution of the heat exchange fluid within the heat exchanger assembly 20. In addition, the coupler 98 allows for more flexibility in manufacturing by reducing time of placing and welding various pieces for the external plumbing attached to the heat exchanger assembly 20 and also can reduce overall costs by limiting the number of pieces and steps necessary to complete manufacture of the heat exchanger assembly 20. It is to be appreciated that the external tube 100 may be located in the above locations and orientations without the coupler 98. For example, the external tube 100 may be disposed within the port 96 such that the external tube 100 extends through the tubular wall 26 and into the flow path FP and, optionally, though one of the orifices 66 of the insert 52 and into the distribution chamber 56.

The heat exchanger assembly 20 may include a plurality of passes for forming a multi-pass configuration within the heat exchanger assembly 20. In one embodiment, as shown in FIGS. 16 and 17, a first pass 84 and a second pass 86 adjacent to the first pass 84 are defined within the heat exchanger assembly 20. The first and second passes 84, 86 may each include flow tubes 44 and optionally flow tube groups 46. In other embodiments, the heat exchanger assembly 20 may include three or more passes. For example, as shown in FIG. 10, the third insert 64 may form a third pass (not shown) in the heat exchanger assembly 20. In another embodiment, the heat exchanger assembly 20 includes one pass. For example, as shown in FIG. 7, the first single-piece manifold 22 and the insert 52 may distribute the heat exchange fluid to the flow tubes 44 in one pass to the second single-piece manifold 24. In one embodiment, as shown in FIGS. 16 and 17, one of the full baffles 92, the insert 52, and the second insert 62, define the first and second passes 84, 86. In another embodiment, as shown in FIG. 8, the insert 52 may define the first pass 84 and the second pass 86. In one embodiment, the first pass 84 and the second pass 86 each include an equal number of the flow tubes 44. In another embodiment, the first pass 84 includes more flow tubes 44 than the second pass 86. This embodiment is often desirable when the heat exchange fluid is essentially a vapor phase while in the first pass 84 and the heat exchange fluid condenses to essentially a liquid phase in the second pass 86. In yet another embodiment, the second pass 86 includes more flow tubes 44 that the first pass 84. The passes 84, 86 will now be further discussed.

Sometimes, the first pass 84 may be relatively controlled because the heat exchange fluid is freshly introduced into the inlet 34 and tends to flood the first pass 84 such that the heat exchange fluid is distributed among the flow tubes 44. However, as the heat exchange fluid changes temperature, shifts phases, and begins to separate due to mass differences between the phases, uniform distribution of the heat exchange fluid to each of the flow tubes 44 in later passes, i.e., the second pass 86, is difficult. As already discussed, the insert 52 is slidably disposed in the flow path FP of either the first or second single-piece manifold 22, 24 for uniformly distributing the heat exchange fluid to the flow tubes 44. As such, the insert 52, and optionally, the second insert 62, may be used to control distribution of the heat exchange fluid in each of the passes 84, 86. As best shown in FIG. 16, the insert 52 is slidably disposed in the first single-piece manifold 22 along with the second insert 62. The second insert 62 may be used to direct heat exchange fluid from the flow tubes 44 in the first pass 84 to the insert 52. The insert 52 may then uniformly distribute the heat exchange fluid to the distribution chamber 56, and the distribution chamber 56 may then uniformly distribute the heat exchange fluid to the flow tubes 44 in the second pass 86. In another embodiment, as shown in FIG. 17, the second insert 62 is slidably disposed in the flow path FP of the second single-piece manifold 24 proximal to the inlet 34. This embodiment is especially useful in uniformly distributing the heat exchange fluid received from the inlet 34 to each of the flow tubes 44 in the first pass 84, because typically, the flow tubes 44 closest to the inlet 34 become flooded with more of the heat exchange fluid than the flow tubes 44 farther away from the inlet 34. As also shown in FIG. 17, the insert 52 is slidably disposed in the flow path FP of the first single-piece manifold 22 and uniformly distributes the heat exchange fluid received from the first pass 84 to the second pass 86. As also shown in FIG. 17, the third insert 64 is slidably disposed in the flow path FP of the second single-piece manifold 24. This embodiment may be helpful when the heat exchange fluid is drawn from the outlet 36, such that the distribution chamber 56 defined by the third insert 64 uniformly draws the heat exchange fluid through each of the flow tubes 44 in the second pass 86 from the second single-piece manifold 24. It should be appreciated that a plurality of configurations and passes are available with all the embodiments of the heat exchanger assembly 20 as taught above.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A heat exchanger assembly comprising:

a first manifold extending along an axis;

a second manifold extending along an axis in spaced and parallel relationship with said first manifold;

each of said manifolds including a pair of ends spaced from each other;

each of said manifolds having an endless tubular wall as viewed in cross-section and extending axially between said ends;

said tubular wall of each of said manifolds defining a plurality of tube apertures being spaced from each other;

a plurality of flow tubes extending in spaced and parallel relationship transversely between said tube apertures of said manifolds for communicating a heat exchange fluid between said manifolds;

a plurality of air fins disposed between said flow tubes for increasing the surface area of said flow tubes;

said tubular wall of said first manifold as viewed in cross-section including a plurality of circumferentially spaced and diametrically opposed radial indentations;

an insert presenting a distribution surface disposed in said endless tubular wall of said first manifold and defining a flow path on one side of said insert for receiving the heat exchange fluid and a distribution chamber on the other side of said insert in fluid communication with said flow tubes;

said insert defining a center line parallel to said axis and extending along said distribution surface;

a pair of opposed side flanges integrally connected to said insert and extending from said distribution surface of said insert and along opposite sides of said tubular wall of said first manifold and engaging said indentations for orienting and securing said insert against rotation in said first manifold; and said distribution surface of said insert defining a plurality of orifices being spaced from each other for uniformly distributing the heat exchange fluid in said flow path across said distribution chamber.

2. The assembly as set forth in claim 1 wherein said radial indentations integrally connect a lower distribution chamber sector with a diametrically wider flow path sector.

3. The assembly as set forth in claim 1 wherein said orifices are spaced from each other and spaced from said center line.

4. The assembly as set forth in claim 1 wherein said orifices are equally spaced along said center line of said distribution surface of said insert.

5. The assembly as set forth in claim 1 wherein each of said side flanges has a cross-section presenting a curve to complement said tubular wall of said first manifold.

6. The assembly as set forth in claim 1 and including an end cap disposed at each of said ends of said first and second manifolds for sealing said ends to retain a heat exchange fluid within said heat exchanger assembly.

7. The assembly as set forth in claim 1 wherein said tubular wall of each of said first and second manifolds presents a cross-section having a circular shape and extending between said ends to define a circular-shaped flow path.

8. The assembly as set forth in claim 7 wherein said circular-shape cross-section of said tubular wall of each of said first and second manifolds defines a diameter width.

9. The assembly as set forth in claim 8 wherein said insert includes at least one separator integrally connected to said distribution surface at one of said insert ends and extending outwardly toward said tubular wall of said first manifold for obstructing at least a portion of the diameter width of said first manifold and for directing the heat exchange fluid through said heat exchanger assembly.

10. The assembly as set forth in claim 1 wherein at least one of said first and second manifolds defines an inlet port for communicating the heat exchange fluid to said heat exchanger assembly.

11. The assembly as set forth in claim 1 wherein at least one of said first and second manifolds defines an outlet port for communicating the heat exchange fluid from said heat exchanger assembly.

12. The assembly as set forth in claim 1 wherein said air fins define a plurality of corrugations.

13. A heat exchanger assembly comprising:

a first manifold extending along an axis;

a second manifold extending along an axis in spaced and parallel relationship with said first manifold;

each of said manifolds including a pair of ends spaced from each other;

an end cap disposed at each of said ends of said first and second manifolds for sealing said manifold ends to retain a heat exchange fluid within said heat exchanger assembly;

each of said manifolds having an endless tubular wall presenting a cross-section having a circular shape and extending axially between said ends;

said tubular wall of each of said manifolds defining a diameter width;

at least one of said first and second manifolds defining an inlet port for communicating the heat exchange fluid to said heat exchanger assembly;

at least one of said first and second manifolds defining an outlet port for communicating the heat exchange fluid from said heat exchanger assembly;

said tubular wall of each of said manifolds defining a plurality of tube apertures being spaced from each other;

a plurality of flow tubes extending between said tube apertures of said manifolds for communicating a heat exchange fluid between said manifolds;

a plurality of air fins being corrugated and disposed between said flow tubes for increasing the surface area of the flow tubes;

said tubular wall of said first manifold as viewed in cross-section including a plurality of circumferentially spaced and diametrically opposed radial indentations;

an insert presenting a distribution surface disposed in said endless tubular wall of said first manifold and defining a flow path on one side of said insert for receiving the heat exchange fluid and a distribution chamber on the other side of said insert in fluid communication with said flow tubes;

said insert having a pair of insert ends and said distribution surface extending therebetween;

said insert defining a center line parallel to said axis and extending along said distribution surface;

a pair of opposed side flanges integrally connected to each insert and extending from said distribution surface of said insert and along opposite sides of said tubular wall of said first manifold;

said pair of side flanges having a cross-section presenting a curve to complement said circular cross-section of said tubular wall of said first manifold;

said pair of side flanges extending along said tubular wall of said first manifold and engaging said indentations for orienting and securing said insert against rotation in said first manifold;

said insert including at least one separator integrally connected to said distribution surface at one of said insert ends and extending outwardly toward said tubular wall of said first manifold for obstructing at least a portion of the diameter width of said first manifold and for directing the heat exchange fluid through said heat exchanger assembly;

at least one of said separators defining a hole for directing the heat exchange fluid through the heat exchanger assembly;

at least one baffle slidably disposed in said flow path of one of said first and second manifolds and having a perimeter engaging said tubular wall for obstructing at least a portion of the width of said corresponding manifold;

said distribution surface of said insert defining a plurality of orifices being equally spaced from each other for uniformly distributing the heat exchange fluid in said flow path across said distribution chamber for uniform distribution between said flow tubes; and said radial indentations integrally connecting a lower distribution chamber sector with a diametrically wider flow path sector.

14. The assembly as set forth in claim 13 wherein said orifices are spaced with one of said orifices being aligned with each of said flow tubes.

15. The assembly as set forth in claim 13 wherein said orifices are spaced from each other and spaced from said center line.

16. The assembly as set forth in claim 13 wherein said orifices are equally spaced along said center line of said distribution surface of said insert.

* * * * *